United States Patent [19]

Bullard

[11] Patent Number: 4,824,404

[45] Date of Patent: Apr. 25, 1989

[54] SECONDARY TERMINAL LOCK

[75] Inventor: Peter H. Bullard, Harleysville, Pa.

[73] Assignee: Dill Products Incorporated, Norristown, Pa.

[21] Appl. No.: 58,982

[22] Filed: Jun. 8, 1987

[51] Int. Cl.[4] ..... H01R 13/426

[52] U.S. Cl. ..... 439/752

[58] Field of Search ..... 439/357, 358, 744, 747, 439/748, 752

[56] References Cited

U.S. PATENT DOCUMENTS 4,557,542 12/1985 Coller et al. ..... 439/595

4,602,839 7/1985 Winger ..... 439/358

FOREIGN PATENT DOCUMENTS 531393 9/1954 Belgium ..... 439/744

*Primary Examiner*—Eugene F. Desmond

*Attorney, Agent, or Firm*—Richard D. Weber

[57] ABSTRACT

A secondary terminal lock assembly for preventing the removal of an electrical terminal from a terminal block. The lock assembly includes a lock element which is inserted into a terminal block cavity adjacent a conventional female spring locked terminal. The lock element includes a notched locking tongue which engages a locking ear of the terminal block cavity and is held into engagement with the ear by the terminal spring. Shoulders on the locking element prevent withdrawal of the terminal from the terminal cavity. The locking element when properly seated can be seen from the plug side of the terminal block and thus provides a visible indication that the terminal is in a locked condition.

10 Claims, 2 Drawing Sheets

SECONDARY TERMINAL LOCK

BACKGROUND OF THE INVENTION

The present invention relates generally to electrical connectors and relates more specifically to a secondary terminal lock for securing electrical conductor terminals in the cavities of terminal blocks.

A wide variety of connectors have been developed for joining the ends of electrical conductors to other elements in a circuit. In mass produced products, such as automotive products and appliances, it is common practice to have the electrical circuits include preassembled wiring harnesses to which elements of the device are connected in a predetermined sequence during assembly. Terminals commonly in use at the ends of the wiring harness wires are typically female terminals of a type suited for mounting in a terminal interface board, which board may be of the modular block type. In automotive applications, for example, such terminal boards may serve for the installation of flashers, circuit breakers, relays and similar elements to facilitate the initial assembly of the vehicle as well as to simplify trouble shooting and replacement should problems arise during use.

A widely-used female terminal for which the present invention has been particularly developed is characterized by a channel shaped body, the outer channel edges of which are inwardly flanged to provide a box-like structure within which a spadeshaped male connector is received. A spring within the terminal body serves to hold the male lug into spring-biased contact with the channel flanges to maintain a good electrical contact between the male and female connector elements.

Terminals of the general type described typically include a primary locking means, for example a tang which cooperates with a shoulder of the terminal board to hold the terminal in the board cavity. While such primary locking means are sufficient for the initial assembly of the terminal block, their failure to hold the terminal in place under stress conditions or under heavy vibrations have necessitated some additional locking arrangement known as a secondary terminal lock. Typically, secondary locks are of the multiple terminal type wherein a single locking element is employed to secure a multiplicity of terminals. Examples of such locks are illustrated, for example, in U.S. Pat. Nos. 4,557,542, issued Dec. 10, 1985, and 4,602,839, issued July 29, 1986. Locking devices of this type typically require extensive modification of the terminal board for their accomodation and in some cases the terminal itself may be of a special design to cooperate with the secondary lock element.

SUMMARY OF THE INVENTION

The secondary lock of the present invention comprises a lock element, preferably made of a molded plastic, which is slid into the terminal block cavity alongside of each terminal. The lock element includes a notched tongue which is adapted to slide between the cavity wall and the spring member of the terminal until the notch therein engages an ear extending from the cavity wall. The terminal spring biases the tongue into engagement with the cavity wall and prevents the withdrawal of the lock element. Shoulders of the lock element engage the outer end edges of the terminal, effectively preventing terminal withdrawal from the cavity. The lock element when properly seated can be seen from the front of the terminal block and provides a positive indication that both the terminal and the secondary lock element are properly seated.

It is accordingly a first object of the present invention to provide a secondary lock for an electrical terminal which prevents the terminal from moving from a predetermined position in a terminal board cavity in the event of primary terminal lock failure.

A further object of the invention is to provide a secondary lock as described which functions independently of the primary terminal lock and allows a terminal to be properly mated even after a primary lock failure.

Another object of the invention is to provide a secondary terminal lock as described which if omitted or withdrawn still permits the terminal to function normally as positioned by the primary lock.

Another object of the invention is to provide a secondary lock as described which when seated can be seen from the front of the terminal block to permit a visual check of the proper locked condition of the terminal.

Still another object of the invention is to provide a secondary terminal lock as described which can only be inserted fully when the terminal is fully seated.

A still further object of the invention is to provide a secondary lock as described which includes a separate lock element for each terminal, thus facilitating the assembly process and permitting selective removal of individual terminals without affecting other terminals in the board.

Still another object of the invention is to provide a secondary lock as described of a simple, inexpensive construction, the employment of which requires only minimal modification of the terminal cavity.

Additional objects and advantages of the invention will be more readily apparent from the following detailed description of an embodiment thereof.

DESCRIPTION OF THE PREFERRED EMBODIMENT

Figure 1:
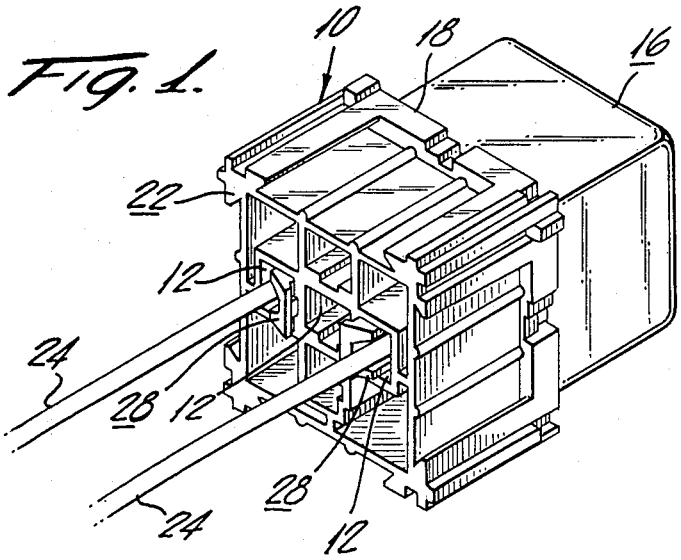
FIG. 1 is a perspective view showing a modular terminal block having a pair of terminals secured therewithin by means of secondary terminal lock assemblies in accordance with the present invention.
Figure 2:
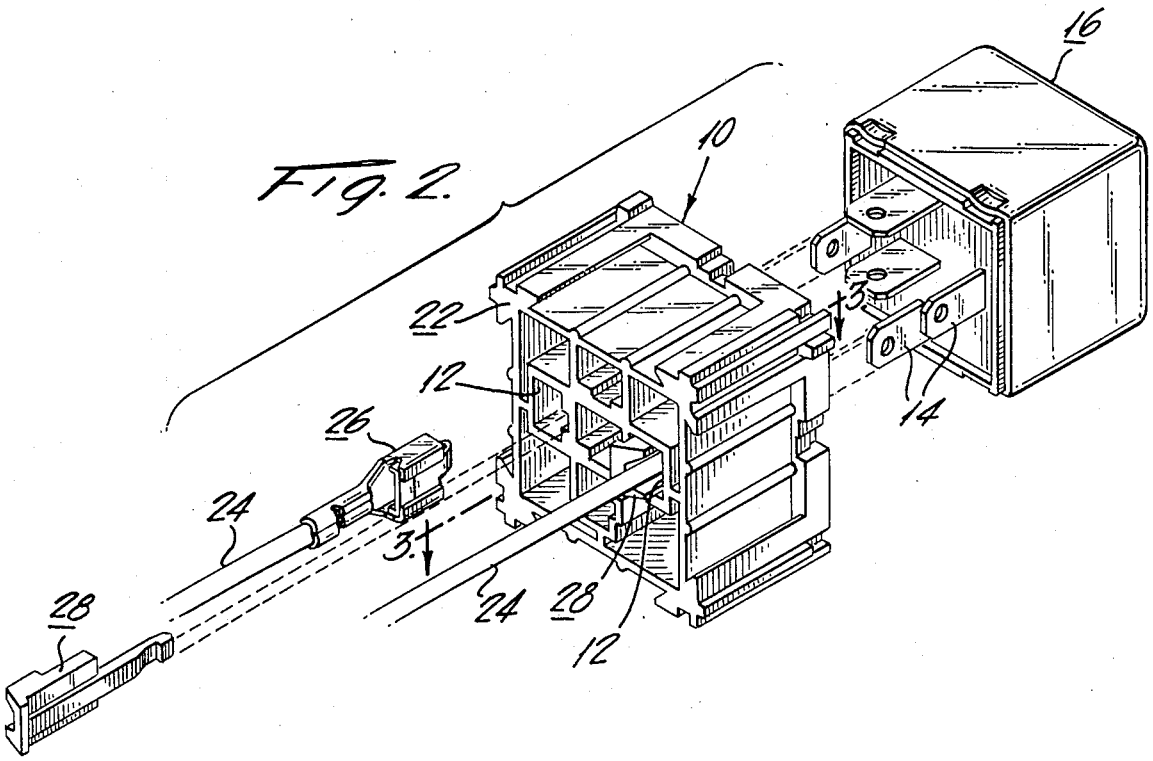
FIG. 2 is an exploded perspective view of the terminal block elements illustrated in FIG. 1.
Figures 3, 4, 5, 6, 7:
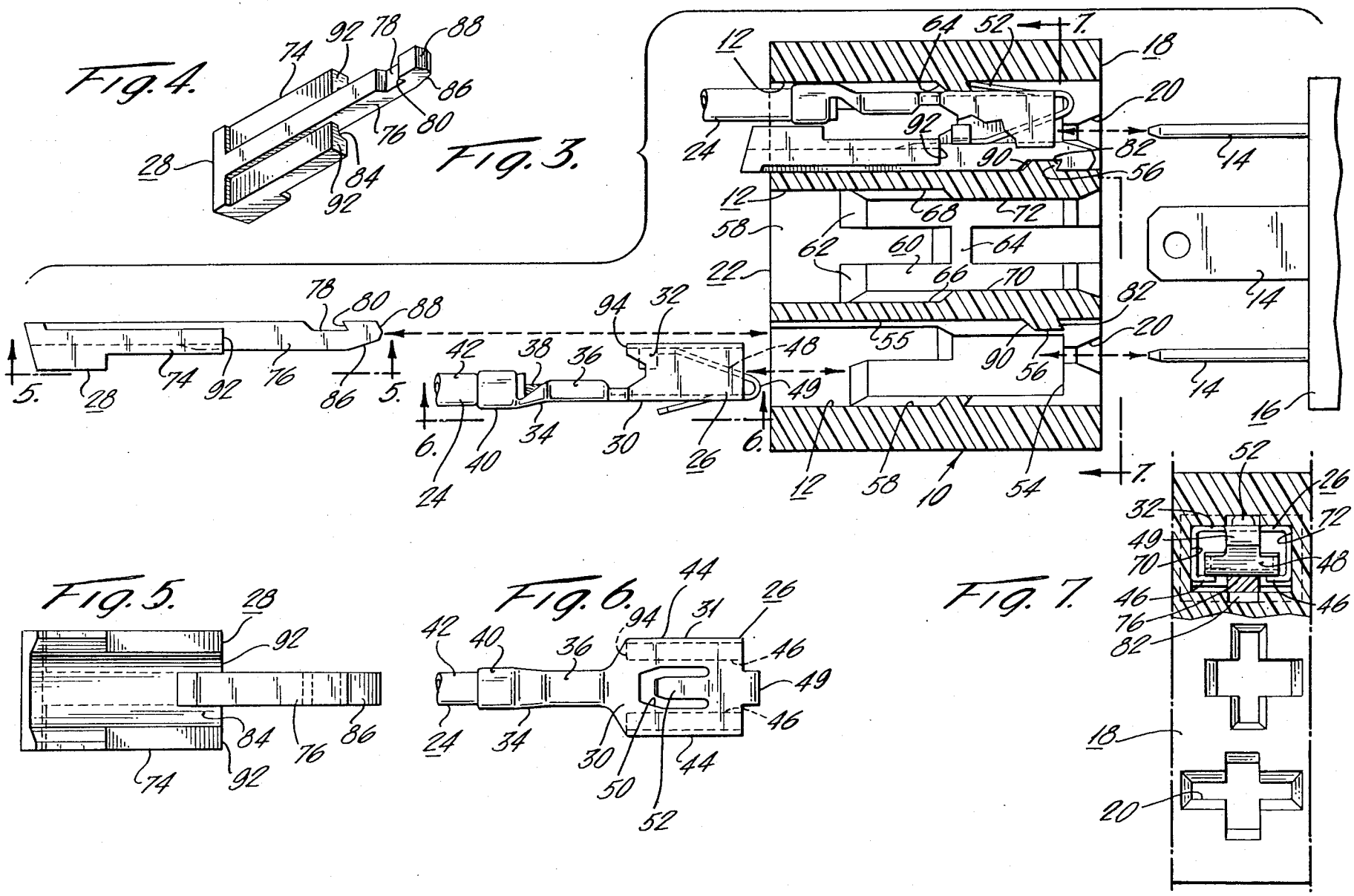
FIG. 3 is an enlarged top plan view of the exploded elements illustrated in FIG. 2 and taken sectionally through the terminal block along the section line 3—3 of FIG. 2.
FIG. 4 is a perspective view of the secondary lock element in accordance with the invention.
FIG. 5 is a view taken along line 5—5 of FIG. 3 showing details of the lock element.
FIG. 6 is a view taken along line 6—6 of FIG. 3 showing details of the terminal.
FIG. 7 is a view partly in section taken along line 7—7 of FIG. 3 showing a portion of the front face of the terminal block.

Referring to the drawings and particularly FIGS. 1-3 thereof, the invention is illustrated as applied to a modular terminal block generally designated 10 of a known type which is adapted for securing a plurality of female electrical terminals within a plurality of terminal cavities 12 thereof. The cavities 12, the interior details of each of which are substantially identical, are disposed in the block 10 in a predetermined arrangement so as to orient the secured terminals in the proper spaced relationship for engagement with the male contact elements of an electrical device 16 which in the embodiment illustrated comprises a relay.

The illustrated terminal block 10 is one of a plurality of such blocks which are mated together to form an electrical interface board and is of the type described in detail in U.S. Pat. No. 4,611,879, issued on Sept. 16, 1986 and assigned with the present application to a common assignee. This type of modular board has particular application in automotive vehicles such as trucks. By adding the desired number and type of terminal blocks, a board may be customized to suit the special requirements of each vehicle's electrical system. The structure and function of the terminal blocks and the manner of their combination to form an interface board are described in the above patent, which is hereby incorporated by reference.

The present invention is directed to a secondary lock assembly for securing female electrical terminals of a particular known type within the cavities 12 of the block 10 and accordingly the description of the block will be limited to the interior structure of the cavities 12. As for the remainder of the block structure, it is sufficient to state that the block includes a front face 18 having a plurality of apertures 20 into which the male contact elements 14 of an appliance 16 are inserted, and a rear face 22 from which the cavities open and from which side of the block the female terminals as well as the secondary lock elements of the invention are inserted and locked.

In the embodiment illustrated, a pair of insulated wires 24 each terminate in a female terminal 26 of a conventional construction and each of the terminals is inserted within and held captive in a predetermined position within one of the cavities 12. A primary terminal lock is provided on the terminal 26 itself as described below and cooperates with the cavity to provide a first means of securing the terminal in place. The present invention in brief comprises a secondary lock element 28 which is inserted into the cavity 12 following insertion of the terminal 26 and which cooperates with the terminal 26 and the cavity configuration to provide a second and independent locking means for the terminal. Details of the terminal 26, the cavities 12 and the lock element 28 will now be considered.

The terminal 26 is entirely conventional and is of a type widely used in the automotive field. The terminal is of a type made and sold by the Packard Electric Division of General Motors Corporation under the trademark METRIPAC and requires no modification for use with the present secondary terminal lock assembly. The terminal 26 is formed from a single piece of sheet metal and includes a generally flat rear face 30 which as viewed in FIG. 6 includes a substantially rectangular portion 31 forming the back of terminal body portion 32 and a necked down wire engaging portion 34. The necked down portion 34 is subdivided into a crimped wire contacting portion 36 for engaging the stranded metal wire 38, and a larger insulation engaging portion 40 which is crimped over the insulation sleeve 42 of the wire 24. The portion 36 establishes a positive electrical contact of the terminal with the metal wire, while the portion 40 provides a mechanical grip on the wire insulation and relieves the strain on the wire connection which might otherwise tend to pull the wire from the crimped fitting. The crimped connection 36 may in addition to crimping be soldered to provide an even better electrical and mechanical connection of the wire to the terminal.

The body portion 32 of the terminal is formed to provide a channel shaped receptacle to receive the male connector and includes side walls 44 extending perpendicularly from the rear face portion 31. The outer edges of the side walls 44 are provided with inwardly directed perpendicular flanges 46 as most clearly shown in FIGS. 2 and 7. A spring plate 48 is integrally formed within the body portion 32 of the terminal by the reverse bending of an extending portion of the rear face 30 at a U-shaped bend 49. The spring plate 48 is, in the absence of a male contact element, resiliently engaged with the inner faces of the flanges 46 as shown in FIG. 3.

A U-shaped slot 50 in the rear face portion 31 of the body portion 32 defines a central locking tang or finger 52 which as shown in FIG. 3 extends at a slight angle from the plane of the terminal face. The tang 52 serves as a primary locking means for the terminal by engagement with a shoulder of the cavity as described below.

The cavities 12 of the terminal block 10 are essentially of a rectangular cross section of sufficient dimensions to receive the terminal and extend from the rear face 22 of the terminal to abutment portions 54 of the block which serve to delineate the apertures 20 through which the male contact elements 14 pass. In order to permit the ready installation of each terminal into its cavity, the outer cavity portion adjacent the rear face 22 is slightly larger than the inner cavity portion wherein the terminal is seated in its locked position. This is accomplished by providing raised portions of three of the four cavity walls and providing ramp-like transition areas to guide the terminal into its intended position.

Considering the specifics of the cavity shape, with reference to FIG. 3 it can be seen that the cavity wall 55 opposed from the flanges 46 of the terminal is a straight wall interrupted only by a locking ear 56 which cooperates with the secondary lock element 28 in a manner described below. The cavity wall 58 opposite the wall 55, as most clearly seen in the center cavity 12 of the block in FIG. 3, is characterized by a substantially H-shaped raised portion 60 having beveled transition portions 62 directed toward the outer end of the cavity. The movement of the terminal into the cavity with the rear face 30 of the terminal juxtaposed the cavity wall 58 results in the locking tang 52 passing between the legs of the H-shaped raised portion 60 until it encounters the cross portion or shoulder 64 over which it passes in a resilient manner and springs back to lock the terminal against withdrawal. As shown in FIG. 3, the forward edge of the shoulder 64 is undercut to capture the outer end of the locking tang 52 when the terminal is fully inserted into the cavity.

The side walls 66 and 68 of each cavity 12 are identical in construction and include raised portions 70 and 72 respectively at the inner end of the cavity to position the terminal laterally in its locked position. As shown in FIG. 7, these wall portions are spaced apart a distance just slightly greater than the width of the body portion 32 of the terminal to provide a snug seating of the terminal in its operating position.

The apertures 20 are disposed with respect to the cavities 12 so as to guide the male contact elements 14 into the body portion 32 of the terminal between the spring plates 48 and the flanges 46.

With the exception of the ears 56, the cavities described are of a substantially conventional shape for holding of the terminals of the type described. The introduction of the terminals from the rear face 22 of the block as indicated by the arrows for the lower terminal in FIG. 3, is a simple task since the raised portions 60, 70 and 72 of the respective cavity walls 58, 66 and 68 guide the terminal into its operating position as shown in the upper cavity of FIG. 3, at which point the locking tang 52 automatically locks the terminal in place by cooperating with the shoulder 64.

The present secondary lock assembly comprises the lock element 28 which as indicated above is inserted into each cavity 12 following the insertion and primary locking of a terminal 26. The lock element 28, which is preferably molded of a plastic material of a contrasting color to the molded block 10, includes an elongated generally rectangular body portion 74 from which extends a locking tongue 76 having a notch 78 toward the outer end thereof. As shown in FIG. 3, the notch 78 is undercut at 80 at its outer end to cooperate with a similarly angled surface 82 of the ear 56 of the cavity. The body portion 74 of the lock element is relieved in the central region 84 to facilitate movement of the lock element along the wire 24 and terminal portions 36 and 40 during introduction of the element into the cavity.

With a terminal in place in one of the cavities, the installation of the secondary lock element 28 is carried out as illustrated in the lower portion of FIG. 3 by sliding the lock element tongue first into the cavity with the notch 78 of the tongue adjacent the cavity wall 54. As the tongue moves adjacent the body portion 32 of the terminal 26 already in place in the cavity, the end of the tongue engages the spring plate 48 and moves the spring plate away from the flanges 46 temporarily. A beveled portion 86 of the tongue end facilitates this engagement with the spring plate and permits the tongue to ride over the outer surface of the spring plate. As the insertion of the lock element 28 progresses, the tip of the tongue 76 and specifically a beveled surface 88 thereof engages a beveled surface 90 of the cavity ear 56, allowing the tongue to ride over the ear although resiliently urged thereagainst by the force of the spring plate 48.

When the element 28 reaches its fully engaged locked position as shown in the upper cavity of FIG. 3, the ear 56 drops into the notch 78 of the lock element tongue and the undercut surface 80 of the notch engages the similarly beveled surface 82 of the ear to lock the element against retraction. The force of the spring plate 48 holds the tongue in the locked position, in which position the spring plate 48 is again in engagement with the flanges 46. The locking tongue 76, although temporarily during insertion occupying the position in the terminal body channel ultimately to be occupied by the male contact elements 14, upon reaching the locked position drops out of the terminal body channel and does not interfere with the later entrance of the male contact.

When the lock element 28 is seated in the locked position with the ear 56 of the cavity wall engaging the notch 78 of the locking tongue, the end faces 92 of the lock element body portion 74 engage the ends 94 of the terminal flanges 46, thus preventing outward movement of the terminal in the event of the failure of the primary lock means, namely the locking tang 52. The secondary lock element will not seat in its locking position unless the terminal has already been properly seated in its primary locked position. Visual assurance of the correct installation of the terminal and the secondary lock can be obtained by viewing the apertures 20 at the front of the block 10 since the end of the locking tongue 76 will be prominently visible in the aperture 20, particularly if the lock element is of a contrasting color to the block. In a preferred embodiment, the block is molded of a black plastic material while the lock elements are formed from a bright yellow plastic material.

The introduction of a male contact 14 into a terminal cavity in which a terminal is locked by the present secondary lock substantially increases the locking effect provided by the secondary lock since the male contact 14 is interposed between the spring 48 and the lock element tongue 76, thereby increasing the spring pressure on the tongue. Furthermore, the apertures 20 are sized so as to permit only minimal transverse movement of the male elements which in addition are rigidly attached to the housing of the device 16. These factors effectively prevent a transverse movement of the lock element tongue and hence prevent its disengagement from the cavity ear.

Should removal of the secondary lock and terminal be necessary for any reason, a small tool or a stiff wire can be inserted into the aperture 20 following removal of the male element 14 and the tongue of the lock element moved against the spring pressure to free the tongue notch from the cavity ear, thus allowing the secondary lock element to be pulled rearwardly from the cavity. Similarly, the insertion of a small element through aperture 20 against the primary locking tang 52 can resiliently free the tang from the shoulder 64 and permit the rearward withdrawal of the terminal.

Although in the illustrated embodiment the latching means for securing the lock element within the cavity comprises a notch in the lock element tongue and an ear on the cavity wall, it will be obvious that this arrangement could be reversed and that the latching means could comprise an ear on the lock element tongue and a cooperating notch in the cavity wall.

Although the relationship should be obvious from the above description, it will be noted with particular reference to FIG. 7 that the width of the lock element tongue 76 should be narrower than the distance between the terminal flanges 46 to allow the tongue to slide freely between the flanges and engage only the spring plate 48.

From the foregoing it will be apparent that the secondary lock functions independently of the primary lock, and that a failure of either the primary or secondary lock will not prevent the other lock from carrying out its function. The present secondary lock assembly is accordingly a completely independent lock of a very simple but extremely effective construction. The present device is small, lightweight and inexpensive and does not significantly change the size of the cavity required in a terminal board or block.

Manifestly, changes in details of construction can be effected by those skilled in the art without departing from the invention.

I claim

1. A secondary lock assembly for securing an electrical female terminal within a cavity of a terminal block and wherein said terminal comprises a channel-shaped opening for receiving a male contact and further comprises a spring for engagement with said male contact, said secondary lock assembly comprising a lock element having a locking tongue, said lock element being adapted for sliding entry into a terminal block cavity adjacent a terminal previously positioned in said cavity, said locking tongue engaging said terminal spring and being resiliently biased by said spring toward a wall of said cavity, latching means cooperatively disposed on said lock element tongue and the cavity wall against which said tongue is biased by said spring, said latching means in conjunction with said spring effecting a locking of said secondary lock element against withdrawal from said cavity when said lock element is fully seated within said cavity, and means on said lock element for preventing withdrawal of said terminal from said cavity when said lock element is in the locked position thereby holding said terminal fixedly within said cavity in a predetermined position.

2. The invention as claimed in claim 1, wherein said latching means comprises a notch in said lock element tongue and an ear on said cavity wall engageable with said notch in the fully seated position of said lock element.

3. The invention as claimed in claim 1, wherein said means on said locking element for preventing withdrawal of said terminal from said cavity comprises a shoulder on said lock element abutting the outer end of a portion of the terminal.

4. A secondary lock assembly for securing an electrical female terminal within a cavity of a terminal block and wherein said terminal comprises a terminal body defining a channel-shaped opening for receiving a male contact, a spring plate within said channel-shaped opening for resiliently biasing the male contact into engagement with opposed flanges of said terminal body, said secondary lock assembly comprising a lock element having a locking tongue, said lock element being adapted for sliding entry into a terminal block cavity adjacent a terminal previously positioned in said cavity, said locking tongue being adapted to slide freely between said terminal body flanges in engagement with said terminal spring and being resiliently biased by said spring toward a wall of said cavity, latching means cooperatively disposed on said lock element tongue and the cavity wall against which said tongue is biased by said spring, said latching means in conjunction with said spring effecting a locking of said secondary lock element against withdrawal from said cavity when said lock element is fully seated within said cavity, and means on said lock element for preventing withdrawal of said terminal from said cavity when said lock element is in the locked position thereby holding said terminal fixedly within said cavity in a predetermined position.

5. The invention as claimed in claim 4, wherein said latching means comprises a notch in said lock element tongue and an ear on the cavity wall against which said tongue is biased by said spring, said ear being engageable with said notch to lock said lock element against withdrawal when said lock element is in the fully seated position.

6. The invention as claimed in claim 4, wherein said means on said lock element for preventing withdrawal of said terminal from said cavity comprises a shoulder on said lock element engageable with the end of a portion of said terminal body.

7. The invention as claimed in claim 4, wherein said lock element is formed of a molded plastic material.

8. The invention as claimed in claim 4, wherein said lock element tongue in the fully seated locked position of said lock element lies immediately adjacent but clear of the channel-shaped opening of said terminal body, whereby a male contact element when introduced into said channel-shaped opening is disposed immediately adjacent said lock element tongue, thereby preventing transverse movement of said tongue and augmenting the biasing force of said spring in maintaining the locked condition of said latching means.

9. The invention as claimed in claim 4, wherein said terminal block includes a terminal block aperture through which a male contact enters the terminal opening and wherein said lock element tongue in the fully seated locked position of said lock element extends into and is visible through said terminal block aperture, thereby providing a visual indication of the locked condition of said secondary lock and terminal.

10. An arrangement for securing an electrical female terminal within a cavity of a terminal block, said terminal comprising a terminal body defining a channel-shaped opening for receiving a male contact, a spring plate within said channel-shaped opening for resiliently biasing the male contact into engagement with opposed flanges of said terminal body, a primary terminal lock comprising a resilient tang extending from said terminal body and engageable with a shoulder of a cavity wall in the fully seated position of the terminal, and a secondary lock assembly comprising a lock element having a locking tongue, said lock element being adapted for sliding entry into a terminal block cavity adjacent a terminal previously positioned in said cavity, said locking tongue being adapted to slide freely between said terminal body flanges in engagement with said terminal spring and being resiliently biased by said spring toward a wall of said cavity, latching means cooperatively disposed on said lock element tongue and the cavity wall against which said tongue is biased by said spring, said latching means in conjunction with said spring effecting a locking of said secondary lock element against withdrawal from said cavity when said lock element is fully seated within said cavity, and means on said lock element for preventing withdrawal of said terminal from said cavity when said lock element is in the locked position thereby holding said terminal fixedly within said cavity in a predetermined position.

* * * * *